United States Patent [19]

Mansell

[11] Patent Number: 4,626,736

[45] Date of Patent: Dec. 2, 1986

[54] CATHODE RAY TUBE AND AN ELECTRON MULTIPLYING STRUCTURE THEREFOR

[75] Inventor: John R. Mansell, West Sussex, England

[73] Assignee: U.S. Philips Corporation, New York, N.Y.

[21] Appl. No.: 695,998

[22] Filed: Jan. 29, 1985

[30] Foreign Application Priority Data

Feb. 8, 1984 [GB] United Kingdom ..... 8403298

[51] Int. Cl.[4] ..... H01J 31/48

[52] U.S. Cl. ..... 313/399; 313/105 CM

[58] Field of Search ..... 313/399, 400, 401, 105 R, 313/105 CM, 104, 352, 355

[56] References Cited

U.S. PATENT DOCUMENTS

| | | | |
|---|---|---|---|
| 4,023,063 | 5/1977 | King et al. | 313/105 CM |
| 4,041,343 | 8/1977 | Orthuber | 313/105 R |
| 4,329,617 | 5/1982 | Littwin | 313/355 |
| 4,482,836 | 11/1984 | Washington et al. | 313/105 CM |

*Primary Examiner*—David K. Moore

*Attorney, Agent, or Firm*—David R. Treacy

[57] ABSTRACT

A cathode ray tube comprising a channel plate electron multiplier structure disposed between a source of electrons and an output device such as a cathodeoluminescent screen. The electron multiplier comprises a stack of n apertured dynodes which are separated from each other and are arranged in cascade with the apertures in adjacent dynodes aligned to form channels. In order to improve the resolution of the electron multiplier while enabling the dynodes to be aceptably rigid the axial profile of the apertures in at least the second to the (n−1)th dynodes is such that it comprises a re-entrant portion within the thickness of the dynode with the axially spaced ends of the re-entrant portion being spaced from the respective opposite surfaces of the dynode by a convergent or cylindrical input portion and a divergent or cylindrical output portion. The axial length of the re-entrant portion corresponds substantially to the cross-section of the input (or output) portion at a point where it communicates with the re-entrant portion.

19 Claims, 7 Drawing Figures

CATHODE RAY TUBE AND AN ELECTRON MULTIPLYING STRUCTURE THEREFOR

BACKGROUND OF THE INVENTION

The present invention relates to a cathode ray tube comprising an envelope within which is provided a channel plate electron multiplying structure disposed between electron producing means and an output device the electron multiplying structure comprising a stack of n apertured, substantially planar dynodes, the dynodes being separated from each other by spacing means and being arranged in cascade with the apertures in adjacent dynodes being aligned to form channels.

The present invention also relates to a channel plate electron multiplying structure for use in cathode ray tubes as well as other tubes such as photomultiplier tubes.

British Patent Specification No. 1434053 discloses a discrete electrically conductive dynode of perforate metal sheet form, which dynode is usable in an electron multiplying structure of the type described. The known dynode has an array of apertures which produce electron multiplication through secondary electron emission and which, viewed axially through the thickness of the dynode, are of re-entrant shape, for example concave, such that the input and output cross-sections at the opposite surfaces of the dynode are smaller than that midway through the thickness of the dynode. As it is difficult to make re-entrant shaped apertures by conventional etching techniques, it is customary to make dynodes from two sheets having generally convergent apertures therein and arrange them back-to-back so that the surfaces into which the larger diameter apertures open are in contact with each other.

In order to make a multiple stage electron multiplier then a plurality of such dynodes are arranged as a stack, with the dynodes being separated from each other by a spacing member but with the apertures in the dynodes aligned. The input dynode may be a sheet forming a half dynode and similarly a half dynode may be arranged at the output to form a focusing electrode or accommodation for colour selection electrodes.

As a general rule the input and output cross-sections of the apertures in a dynode are substantially the same and correspond to thickness of a dynode. Thus for example a dynode having apertures at a pitch of 770 μm, has re-entrant shaped apertures with input and output cross-sections of 300 μm and a dynode thickness of 300 μm which means each sheet of the two sheets forming a dynode is 150 μm thick. Such dynodes are reasonably easy to handle and are fairly rigid when assembled as a stack to form a channel plate electron multiplier structure.

In the case of using a laminated dynode electron multiplier as part of a display device, the resolution of the image is dependent upon the pitch of the apertures in the dynodes. In the case of say a display tube having a screen of 300 mm diagonal then ideally the pitch of the apertures should be of the order of 250 μm and the input and output cross-sections of the apertures should be of the order of 100 μm which means that the dynode thickness should be 100 μm and the sheet thickness 50 μm. Sheets and dynodes of such thickness are difficult to handle and also the laminated dynode electron multiplier will not be so rigid and may suffer from microphony.

SUMMARY OF THE INVENTION

It is an object of the present invention to provide a cathode ray tube having an electron multiplying structure formed of a stack of high resolution dynodes which are easier to handle than would be the case if the empirical relationship of the input (or output) aperture cross-section being substantially the same as the thickness of the material is maintained.

According to the present invention there is provided a cathode ray tube comprising an envelope having a faceplate and within the envelope there are provided electron producing means, an output device, and a channel plate electron multiplying structure disposed between said electron producing means and said output device, said electron multiplying structure comprising a stack of n apertured substantially planar dynodes, and spacing means for separating the dynodes from each other, said dynodes being arranged in cascade with the apertures in adjacent dynodes being aligned to form channels, wherein in at least the second to the (n−1)th dynodes the apertures therein each have a re-entrant portion within the thickness of the dynode, the axially spaced ends of the re-entrant portion being spaced from the respective opposite surfaces of the dynode by an input portion and an output portion, the cross-sections of the axially spaced ends of the re-entrant portion which communicate with the input and output portions, respectively, being smaller than a cross-section between said axially spaced ends.

By providing input and output portions to each aperture then it is possible to make the dynodes of thicker, easier to handle material than would be the case if a high resolution dynode was made with the re-entrant aperture extending the full thickness of the sheet.

In order to maintain the desired performance of the dynode the input and output cross-section are substantially equal and the axial length of the re-entrant portion substantially equals one of the input and output cross-sections.

If desired the input portion of the aperture may converge in a direction towards the re-entrant portion and the output portion of the aperture may diverge in a direction away from the re-entrant portion. Alternatively the input and output portions of each aperture may be cylindrical in cross-section.

The dynode may comprise two apertured sheets arranged in physical and electrical contact with each other. The apertures in each sheet may be formed by etching from both sides.

Each aperture may be coaxial about its longitudinal axis. Additionally the cross-sections of the input and output portions at the surfaces of the dynode may be substantially equal.

The output device may comprise a cathodoluminescent screen in the case of the tube being used as a display tube or an output signal electrode in the case of the tube being used as a photomultiplier tube.

The present invention also relates to a channel plate electron multiplying structure comprising a stack of n apertured, substantially planar dynodes and spacing means for separating the dynodes from each other, the dynodes being arranged in cascade with the apertures in adjacent dynodes being aligned to form channels, characterised in that in at least the second to the (n−1)th dynodes the apertures therein each have a re-entrant portion within the thickness of the dynode, the axially spaced ends of the re-entrant portion being spaced from the respective opposite surfaces of the dynode by an input portion and an output portion, the cross-sections of the axially spaced ends of the re-entrant portion which communicate with the input and output portions, respectively, being smaller than a cross-section between said axially spaced ends.

BRIEF DESCRIPTION OF THE DRAWING

The present invention will now be explained and described, by way of example, with reference to the accompanying drawings, wherein.

DESCRIPTION OF THE PREFERRED EMBODIMENTS

Figure 1:
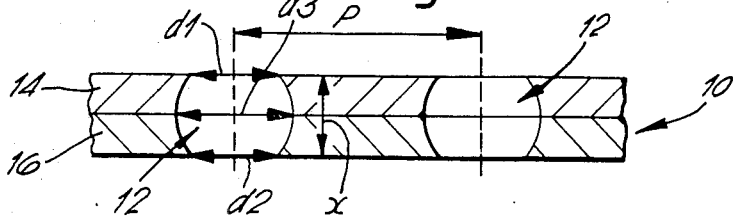
Fig. 1. (Prior Art)
FIG. 1 is a cross-section through a portion of a dynode of the type disclosed in British Patent Specification No. 1,434,053.

In the drawings the same reference numerals have been used to illustrate corresponding parts.

Referring to FIG. 1, the known dynode 10 comprises an apertured planar member having a plurality of re-entrant shaped, for example barrel-shaped, apertures 12 therein. The apertures 12 are generally symmetrical about their longitudinal axes and about a median plane through the dynode. The input and output cross-section d1 and d2 are substantially the same and less than a cross-section d3 within the aperture. The input/output cross-section d1 or d2 of the apertures is usually equal to the thickness x of the dynode 10 and thus may be regarded as having a 1:1 aspect ratio. As an example in a dynode of thickness, $x=300$ μm, the cross-section d1 and $d2=300$ μm and the pitch, P, of the apertures is 770 μm.

It is customary to fabricate the dynode 10 from two sheets 14, 16 of metallic material because it is difficult to etch re-entrant shape apertures in a single sheet. The material may be a known secondary emitting material such as a beryllium/copper alloy or a less expensive material such as mild steel which is a poor secondary emitter. Thus convergent or tapered holes are etched in the sheets 14, 16 which are then arranged back-to-back with the larger diameter openings facing each other. If the dynode material is a poor secondary emitter, such as mild steel, then a secondary emitting material, such as magnesium oxide can be deposited in the apertures 12.

In the case of the example given above the thickness of each of the sheets 14, 16 will be 150 μm. Such sheets can be handled reasonably easily and when a stack of dynodes is assembled with intervening spacers to form a laminated electron multiplier, the assembly is fairly rigid. However in the case of making a dynode having a higher resolution then the pitch P is smaller, and the input and output cross-sections d1 and d2 may have to be smaller which in turn means that the thickness x is smaller. Thus for a pitch of 250 μm, the cross-sections d1 and d2 equal to 100 μm then if the 1:1 aspect ratio is maintained the thickness x is 100 μm requiring the sheets 14, 16 to be 50 μm thick. Such sheets are difficult to handle.

Figure 2:
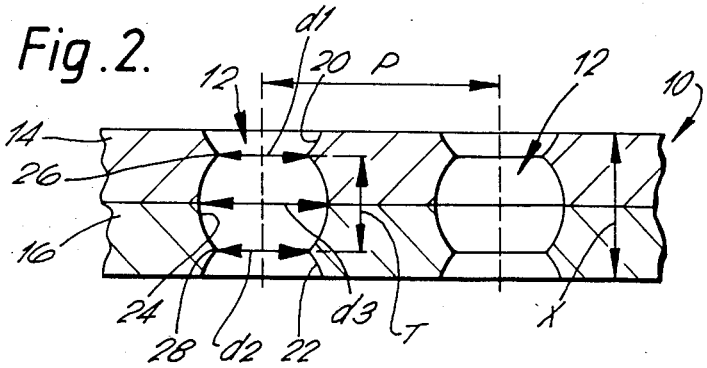
FIGS. 2 and 3 are diagrammatic cross-sections through portions of two different embodiments of dynodes for use in a cathode ray tube made in accordance with the present invention, the input and output portions of each aperture being tapered.
Figure 3:
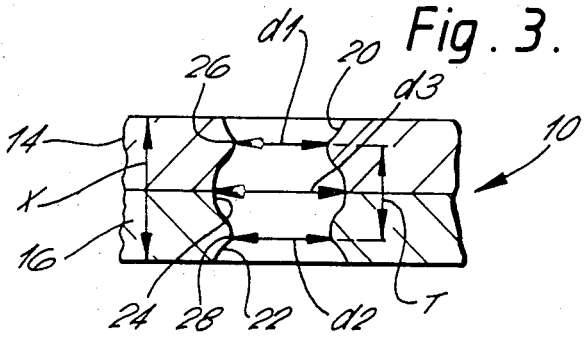

FIGS. 2 and 3 show two embodiments of dynodes 10 which can have a high resolution but which can be made of a thicker, easier to handle, sheet material. In these embodiments the profile of the apertures 12 is such that they comprise a convergent input portion 20, a divergent output portion 22 and a re-entrant intermediate portion 24. The necks 26, 28 formed between the intermediate portion 24 and the input and output portions 20, 22, respectively, have substantially the same cross-sections d1, d2 which are smaller than the cross-section d3 intermediate the necks 26, 28 but are substantially equal to the axial distance T between the necks 26, 28. Thus the intermediate portion 24 in which the electron multiplication takes place maintains the 1:1 aspect ratio. However, by having flared or tapered input and output portions 20, 22 it is possible to increase the thickness X of the dynode whilst providing an electric field between adjacent dynodes such that an efficient gain is obtained. Thus if $d1=d2=T$ is 150 μm then $X=200$ μm allowing the thickness of each sheet 14, 16 to be 100 μm rather than 75 μm as would be the case without the input and output portions 20, 22, respectively. Consequently the sheets 14, 16 are easier to handle.

In order to make the dynode 10 shown in FIG. 2 each of the sheets 14, 16 undergoes double sided etching to form in this example a bi-convergent hole. The sheets 14, 16 are assembled back-to-back to form the dynode 10 as shown in FIG. 2. The apertures thus formed are symmetrical about their medial internal cross-sectional plane. If the sheet material is a poor secondary emitter, for example mild steel, then prior to assembling the sheets 14, 16 a good secondary emitter, such as magnesium oxide, is deposited in at least the electron multiplying portion of the one of the two sheets having the output portion 22.

As shown the apertures 12 are coaxial about their respective longitudinal axes and their cross-sections at the surfaces of the dynode are substantially the same. The input output and intermediate portions 20, 22 and 24, respectively, have a substantially spherical or spheroidal form. However as shown in FIG. 3, the intermediate portion 24 may have a different, circularly symmetrical re-entrant shape.

Figure 4A:
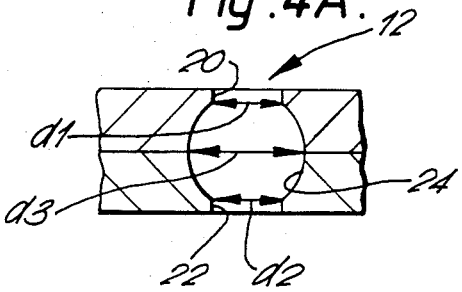
FIGS. 4A and 4B are diagrammatic cross-sections through portions of two different embodiments of dynodes in which the input and output portions are cylindrical but of different axial length.
Figure 4B:
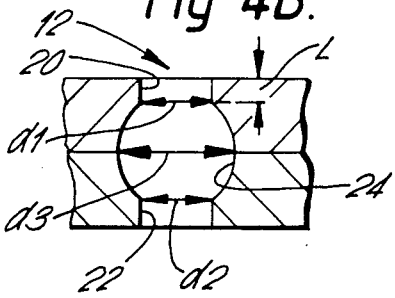

FIGS. 4A and 4B illustrate two embodiments which are variants on the embodiment shown in FIG. 2 in that the input and output portions 20, 22, respectively, are cylindrical, rather than tapered. The two embodiments differ from each other in that the axial length L of the input and output portions 20, 22, respectively, in FIG. 4A is less than that of the corresponding portions in FIG. 4B. Computer ray tracing experiments have indicated for apertures in which $d1=d2=T=300$ μm that L can have a value up to 100 μm in order to obtain a reasonable stage gain at an interdynode voltage of 300 volts. For larger values of L with the values of d1, d2 and T being left unchanged then the stage gain falls off rapidly because the trajectories of the secondary electrons tend to be deflected closer to the axis and accordingly they do not impinge on the next following dynode.

Etching cylindrical holes in metal is generally difficult because the etchant tends to erode the side of a hole as it penetrates into the material. However this does not always occur in non-metallic materials and holes with a cylindrical portion communicating with a tapered portion can be etched in glass, such as Fotoform (Registered Trade Mark of the Corning Glass Company) glass, and then subsequently metallised to form a half dynode.

Figure 5:
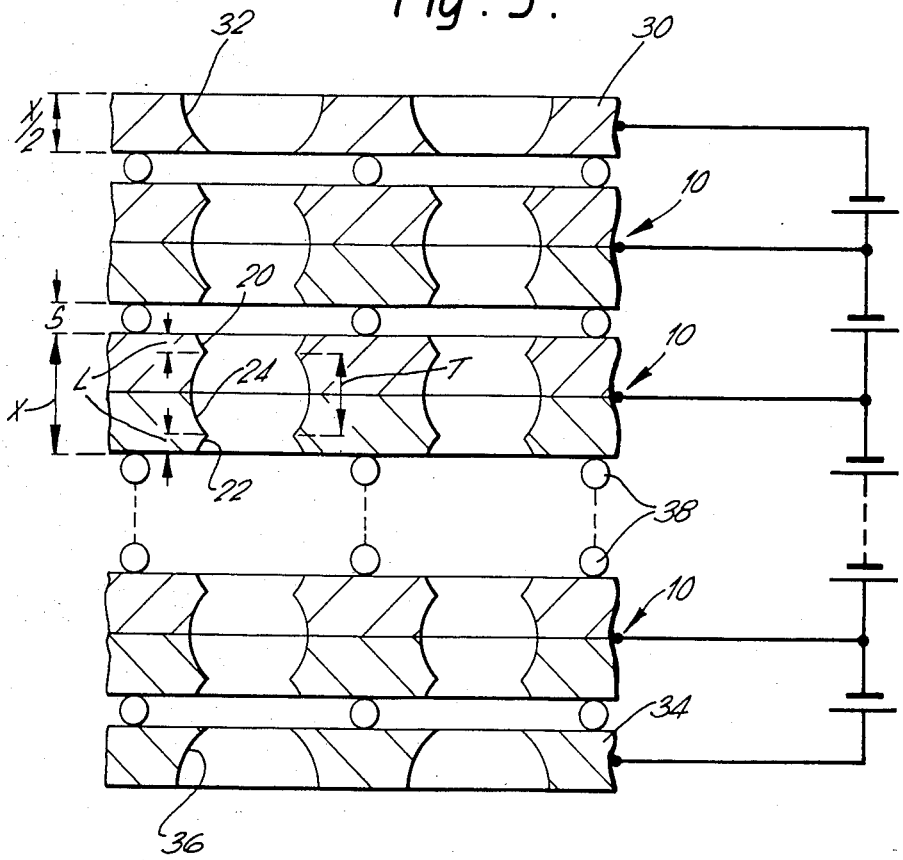
FIG. 5 is a diagrammatic cross-section through a portion of laminated plate electron multiplier structure made in accordance with the present invention.

FIG. 5 illustrates an electron multiplier structure comprising a stack of dynodes of the type shown in FIG. 2 together with an input dynode 30 having convergent apertures 32 and an output dynode 34 with divergent apertures 36. The input and output dynodes 30, 34 are typically half the thickness of the dynodes 10. The dynodes are separated from each other by spacing means which are less conductive than the dynodes and typically comprise insulating material. In the drawing the spacing means comprise ballotini 38 that is, small spheres, or other discrete spacers which may be applied in the manner disclosed in published European Patent Specification No. 0 006 267 details of which are included by way of reference.

A substantially constant potential difference is maintained in use between successive dynodes with the output dynode 34 being at the highest voltage. The precise voltage difference per stage is related to obtaining a satisfactory gain from each dynode. The gain is determined ultimately by the number of electrons which impinge on a dynode and produce secondary electrons which impinge on the next following dynode and so on. Not all the secondary electrons will impinge upon the secondary emitting surface of the next following dynode, some will pass through the aperture in the next following dynode and perhaps leave the electron multiplier. The proportion of the total number of secondary electrons which land on the secondary emitting surface of the next following dynode is determined by the axial length, T, of the re-entrant apertures, the axial length, L, of the input and outut portion 20, 22 and the spacing, S, between adjacent dynodes as well as the voltage difference between successive dynodes. Consequently whilst it is true to say that electron multiplication will take place with different values of T, L, S and dynode voltage, not all such values will give an acceptable gain. Thus by experiment it has been found that an acceptable gain has been achieved by the following electron multipliers:

1. In the case of a stage voltage of 300 V, pitch P=770 μm, T=300 μm, L=100 μm and S=100 μm.
2. In the case of a stage voltage of 400 V, pitch P=770 μm, T=300 μm, L=100 μm and S=150 μm.

This second example when operated at 300 V/stage did not give an acceptable gain from which it can be concluded that if the spacing S is increased then the voltage per stage should be increased, and vice versa.

In another experiment the voltage per stage, T and S were held constant and L was varied until the performance became unacceptable.

These experiments indicated that because only electric fields have to be considered then the dimensions T, L and S can be scaled for a particular interdynode voltage thus in the case of the electron multiplier 10 mentioned above a high resolution dynode can be made by a scaling factor of 50% so that the pitch P is 385 μm, T=150 μm, L=50 μm and S=50 μm but the stage voltage remains at 300 V. In this example because the dynode thickness X=T+2L=150+100=250 μm then the sheet thickness is 125 μm which makes the sheets relatively easy to handle.

Figure 6:
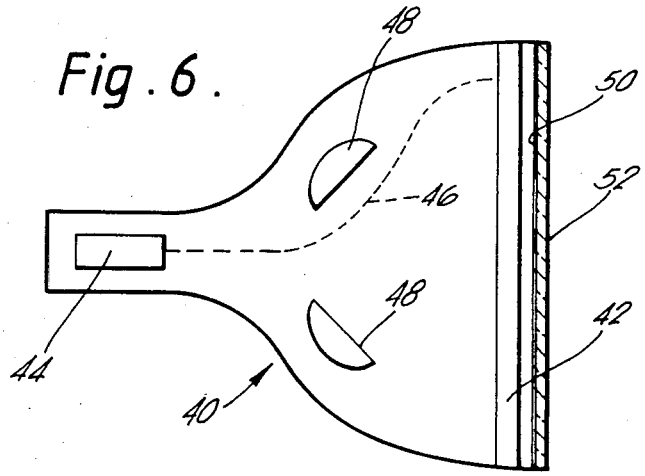
FIG. 6 is a diagrammatic view through an embodiment of a cathode ray tube made in accordance with the present invention.

FIG. 6 illustrates an example of a cathode ray tube 40 including a channel electron multiplier 42. The tube 40 includes an electron gun 44 which produces an electron beam 46 which is scanned by electro-magnetic deflection means 48 over the input side of the electron multiplier 42. A cathodoluminescent screen 50 is provided on a faceplate 52 which is disposed approximately 10 mm from the output side of the electron multiplier 42. An accelerating field is provided between the electron multiplier 42 and the screen 50.

The electron multiplier may be used in other types of cathode ray tube including a flat cathode ray tube disclosed in published European Patent Specification No. 0 070 060. Also the electron multiplying structure may be used to amplify the current produced by a photocathode in a photomultiplier tube.

The number of dynodes used in fabricating the electron multiplier depends on the desired overall gain of the multiplier, that is the smaller the overall gain, the fewer the number of dynodes and vice versa.

I claim:

1. A cathode ray tube comprising an envelope having a faceplate and within the envelope an electron producing means, an output device, and a channel plate electron multiplying structure disposed between said electron producing means and said output device, said electron multiplying structure including a stack of n apertured substantially planar high resolution dynodes, and spacing means for separating the dynodes from each other, said dynodes being arranged in cascade with the apertures in adjacent dynodes being aligned to form channels, wherein the apertures in at least the second to the (n−1)th dynodes each have a multiplying re-entrant portion within the thickness of the dynode, the axially spaced ends of the re-entrant portion being spaced from the respective opposite surfaces of the dynode by an input portion and an output portion, the cross-sections of the axially spaced ends of the re-entrant portion which communicate with the input and output portions, respectively, being smaller than a cross-section between said axially spaced ends.

2. A cathode ray tube as claimed in claim 1, wherein the cross-sections of said axially spaced ends of each said aperture are substantially equal and the axial length of the re-entrant portion substantially equals the cross-section of said axially spaced ends.

3. A cathode ray tube as claimed in claim 1, wherein the input portion of each of said apertures converges in a direction towards the re-entrant portion and the output portion of each of said apertures diverges in a direction away from the re-entrant portion.

4. A cathode ray tube as claimed in claim 1, wherein the input and output portions of each of said apertures are cylindrical.

5. A cathode ray tube as claimed in claim 1, wherein the axial length of the input and output portions of each of said apertures is substantially the same.

6. A cathode ray tube as claimed in claim 1, wherein each of the second to the (n−1)th dynodes comprise two apertured sheets arranged in physical and electrical contact with each other.

7. A cathode ray tube as claimed in claim 6, wherein the apertures in each sheet are formed by etching from both sides.

8. A cathode ray tube as claimed in claim 1, wherein each of said apertures is coaxial about its longitudinal axis.

9. A cathode ray tube as claimed in claim 1, wherein the cross-sections of the input and output portions at the surfaces of the dynode are substantially equal.

10. A cathode ray tube as claimed in claim 1, wherein the apertures in each of the second to the (n−1)th dynodes are symmetrical about a medial internal cross-sectional plane.

11. A cathode ray tube as claimed in claim 1, wherein said apertures are circular in cross-section.

12. A cathode ray tube as claimed in claim 11, wherein said input, re-entrant and output portions of the apertures have a substantially spherical form.

13. A cathode ray tube as claimed in claim 1, wherein the apertures in the first dynode have an aperture form which is tapered and converges in a direction towards the second dynode.

14. A cathode ray tube as claimed in claim 13, wherein the nth dynode has an aperture form which is tapered and diverges in a direction away from the (n−1)th dynode.

15. A cathode ray tube as claimed in claim 1, wherein said output device comprises a cathodoluminescent screen.

16. A channel plate electron multiplying structure comprising a stack of n apertured, substantially planar dynodes, and spacing means for separating the dynodes from each other, said dynodes being arranged in cascade with the apertures in adjacent dynodes being aligned to form channels, wherein in at least the second to the (n−1)th dynodes the apertures therein each have a multiplying re-entrant portion within the thickness of the dynode, the axially spaced ends of the re-entrant portion being spaced from the respective opposite surfaces of the dynode by an input portion and an output portion, the cross-sections of the axially spaced ends of the re-entrant portion which communicate with the input and output portions, respectively, being smaller than a cross-section between said axially spaced ends.

17. A cathode ray tube as claimed in claim 1, wherein said input and output portions each have input and output cross-sections, the cross-sections of the axially spaced ends of said re-entrant portion which communicate with the input and output portions being the same as the output cross-section of the input portion and the input cross-section of the output portion respectively.

18. A cathode ray tube as claimed in claim 17, wherein said input and output portions of each of said apertures are cylindrical.

19. A cathode ray tube as claimed in claim 17, wherein the input portion of each of said apertures converges in a direction toward said re-entrant portion and the output portion of each aperture diverges in a direction away from the re-entrant portion.

* * * * *